United States Patent [19]

Rodebaugh et al.

[11] 4,105,224

[45] Aug. 8, 1978

[54] NOTE PAD ASSEMBLY

[76] Inventors: Helen D. Rodebaugh, 1539 B Lafayette Dr., Columbus, Ohio 43220; William C. Fowler, 226 E. Dunedin Rd., Columbus, Ohio 43214

[21] Appl. No.: 809,291

[22] Filed: Jun. 23, 1977

[51] Int. Cl.[2] ..... B42D 5/00; B43C 3/00

[52] U.S. Cl. ..... 281/15 R; 156/299; 206/460; 206/813

[58] Field of Search ..... 281/1, 3 R, 15 R, 21 R, 281/38; 11/1 AD; 156/297, 299, 300; 206/554, 460, 813; 283/63 R; 428/77, 194

[56] References Cited

U.S. PATENT DOCUMENTS

| | | | |
|---|---|---|---|
| 2,123,903 | 7/1938 | Lane et al. | 281/15 R |
| 2,184,987 | 12/1939 | Carpenter et al. | 281/1 |
| 2,715,493 | 8/1955 | Vogt | 206/554 X |
| 3,915,302 | 10/1975 | Farrelly et al. | 206/460 |

*Primary Examiner*—Robert Louis Spruill
*Attorney, Agent, or Firm*—Sidney W. Millard

[57] ABSTRACT

A note pad and method of fabricating the same. The note pad is characterized in including a plurality of sheets for carrying written messages, each of which is adhesively retained in the assemblage by a pretensioned length of polymeric tape. Discrete sheets are removable from the assemblage in complement with a length of the tape affixed thereto to permit a facile posting thereof at a prominent location. Curling of the pads due to the noted tape pretensioning is avoided by the development of a laminar, structurally rigid compilation of discrete lengths of the tape during fabrication procedures. By pretensioning the tape, undesirable rippling effects otherwise developed during fabrication are avoided.

10 Claims, 10 Drawing Figures

NOTE PAD ASSEMBLY

BACKGROUND

Note pads have been introduced into the marketplace in a great variety of shapes and forms. For the most part, their size can be characterized as somewhat compact, in contemplation of a use wherein a short message is written upon them. These messages may, for example, identify a telephone caller or provide a short reminder of meetings to attend, appointements which have been made or the like. Such messages generally have an immediacy about them and, consequently, the sheets upon which the messages are written are posted at some more highly visible location suited to catch the attention of the intended recipient of the information. For instance, they may be tacked to a bulletin board, or leaned against a prominent item on a business desk such as a telephone. Recently, howsewives have taken to magnetically posting reminders to the family on a surface of a refrigerator utilizing small ornamental magets. Of couse, conventional posting procedures require the posting party to locate a thumb tack, magnetic retainer or a piece of adhesive tape to carry out attachment, an inconvenience sometimes minor and, sometimes, exasperating.

SUMMARY

The present invention is addressed to a novel note padtype assemblage and to the method of its manufacture. Each message carrying sheet of the assemblage is formed incorporating a preattached adhesive bearing polymeric tape. The combined sheet and tape are so configured as to be readily removed from the assemblage, without tearing, one at a time, from first to last. Upon removal, the message-bearing sheet is easily posted at any location by virtue of the exposed adhesive of that portion of the tape protruding beyond an edge of the sheet. The adhesion value of the tape component of each sheet is selected to permit a fascile, not-destructuve removal of the posted message following use.

Another aspect and feature of the invention resides in a "tape-upon-tape" retention of message sheets within as assemblage or pad in combination with a more rigid backing sheet. The tape component of the assemblage serves the dual purpose if retaining the sheets within the assembly and for subsequent posting purposes. To prevent unsightly rippling of the stacked polymeric lengths of tape within the pad, each discrete length thereof is pretensioned, for example, to an extent amounting to about 20% of its specified tensile strength. The pad or assemblage, however, does not curl in consequence of such pretensioning, inasmuch as, due to the adhesive positioning and fixing of one tape surface upon a next adjacent tape surface, there is generated a laminar rigid structuring of polymeric layers. This structuring additionally is observed to contribute a pleasing ornamental aspect to the resultant note pad.

Another feature and object of the invention provides a method for assembling the note pad wherein elongate sheets having a width corresponding to the combined widths of a plurality of pads are assembled upon a backing sheet in sequence in a manner assuring their proper mutual alignment. The technique also serves to assure that the centrally disposed regions of the stacked sheets do not "bloat" i.e. separate vertically within an assembly apparatus in consequence of positioning procedures. Such positioning procedures include the utilization of an inclined assembly surface having two spaced supports. Pretensioning of the polymeric tape, as well as carrying out its proper positioning during assembly is provided through the use of a friction brake tape drum combination with a tape positioning element requiring the removal of tape from a roll thereof at an acute angle with respect to a vertical from the assembly surface. Following assembly of a composite width of pads, discrete assemblages are sheared therefrom by a press cutter or the like.

Other objects of the invention will, in part, be obvious and will, in part, appear hereinafter.

The invention, accordingly, comprises the note pad assembly and method of its fabrication having the construction, combination of elements, arrangement of parts and fabricational steps which are exemplified in the following datailed disclosure.

For a fuller understanding of the nature and objects of the invention, reference should be had to the following detailed description taken in conjunction with the accompanying drawings.

DETAILED DESCRIPTION

Figure 1:
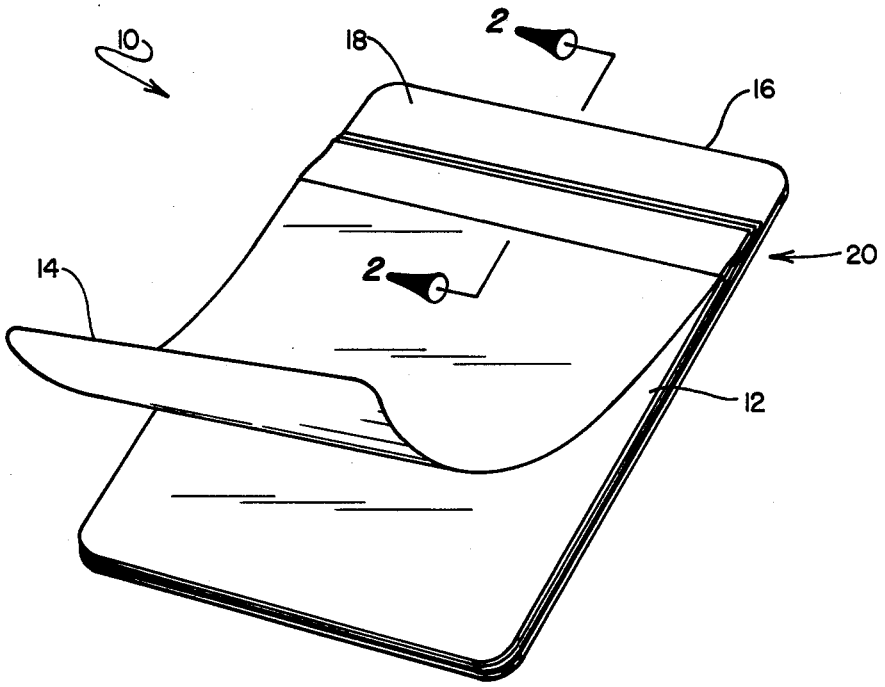
FIG. 1 is a perspective representation of a note pad assembly according to the instant invention.

The note pad of the invention is revealed in general at 10 in FIG. 1. Note from the figure that note pad 10 represents as assemblage of paper sheets 12, the uppermost one of which is shown at 14. Each of the sheets of the assemblage 12 are individually adhesively affixed along their uppermost edge to a backing sheet 16. Backing sheet 16 is formed of a material more rigid than sheets within the assemblage 12. For example, a preferred material is identified as 175 pound Tag, this material representing a rigidity intermediate that of chipboard and index card stock. A preferred paper for assemblage 12 to be used with such backing sheet material is conventional sixteen pound stock. Both the assemblage of sheets 12 and backing 16 are formed having generally rectangular configurations and the lowermost edges as well as the sides and uppermost edges are shown to be stacked in substantial mutual alignment.

Note, however, that the backing sheet 16 has a dimension, for example, which may be designated a "height", which is of greater extent than the corresponding height of each sheet within assemblage 12. Such an arrangement provides for the exposure of a portion of the upwardly disposed surface of backing sheet 16, as revealed at 18. As discussed in more detail later herein, the corresponding width of both the assemblage 12 as well as backing sheet 16, for the preferred material described, is limited to a maximum value of about 4 inches to avoid curling effects and the like. This maximum value also serves as a convenient dimension for typical note pad usage. Additionally, it has been found desirable to limit the number of information carrying sheets within assemblage 12 to about 20 sheets to permit more facile fabrication of the pad 10 as well as to enhance the ornamental or aesthetic appearance of the assemblage.

The sheets within assemblage 12 are discretely affixed, one upon the other, and the entire assemblage 12 is adhesively affixed to backing sheet 16 at exposed portion 18 by a polymeric tape and adhesive compilation shown generally at 20. Compilation 20 represents a prestressed structural component of the entire note pad and arrangement 10.

Figure 2:
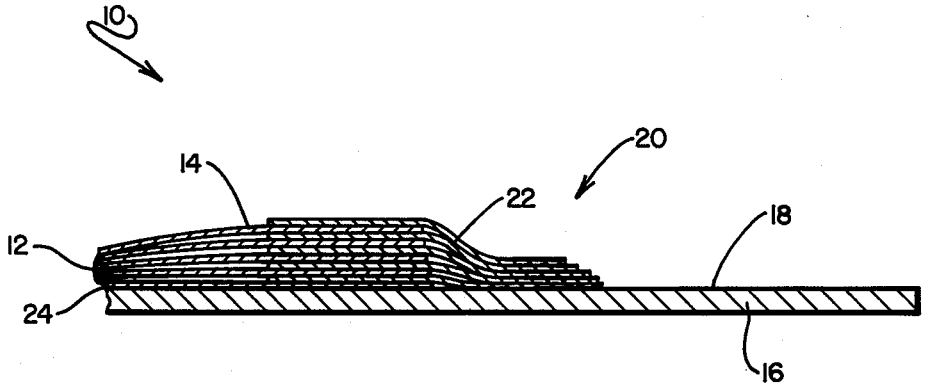
FIG. 2 is an exaggerated and partial section taken through the plane 2—2 of FIG. 1 showing the tape connection of sheets within the assemblage thereof to each other as well as to a backing sheet.

Looking additionally to FIG. 2, an exaggerated representation of the compilation 20 is depicted. Note, that attachement of each sheet within assemblage 12 is by a discrete length of polymeric tape 22 of predetermined width, preferably about one half inch. Each of the discrete lengths of tape carries an adhesive upon the downwardly disposed surface thereof.

Prestressed during fabrication of the assembly 10, each discrete tape length 22 is attached to an extent of about one half of its' width to the region of an associated sheet within assemblage 12 adjacent the uppermost edges thereof. FIG. 2 reveals, for example, that uppermost sheet 14 is fixed within the assemblage 10 by a length of polymeric tape 22, the portion of that tape protruding over the uppermost edge of sheet 14 (about one half of the tape width) being affixed to a next adjacent upper surface of a length of tape 22. Such attachment is seen to be reiterated to two lowermost sheet of assemblage 12 at 24. The protruding portion of tape length 22 affixed to lowermost sheet 24 is adhesively attached to exposed portion 18 of backing sheet 16. Note additionally, that the uppermost edges of each sheet within assemblage 12 are stacked in substantial alignment. Even though each of the discrete lengths of tape 22 are prestressed, the laminar assemblage developed in formation of the note pad serves to evolve a rigid structural entity contributing to the widthwise rigidity of the entire assemblage, including backing sheet 16. Accordingly, each note pad 10, including both assemblage of sheets 12 and backing sheet 16, is observed not to curl in the course of utilization. The adhesion value of the adhesive utilized on the lower disposed surface of each length of tape 22 is slected such that each tape length 22 and associated sheet within assemblage 12 can be removed from the pad 10 without disturbing a next lower disposed sheet and length of tape 22. Generally, the user grasps a lower corner of a sheet within assemblage 12 and pulls diagonally upwardly to provide facile removal of the grasped sheet without interference with the remaining sheets assemblage 12. Note additionally, that the sheets within assemblage 12 are retained by virtue of only the adhesion of protruding portions and mutually adjacent adhesively attached portions of the lengths of polymeric tape. This "tape-on-tape" arrangement facilitates the noted removal of each discrete sheet within assemblage 12 from first uppermost 14 to last lowermost 24.

In use, following the provision of a written message on the uppermost exposed sheet within assemblage 12, the sheet is removed as described above, thereby exposing the adhesive upon the protruding portion of associated length of polymeric tape 22. The message carrying sheet then is posted at a convenient location, for example upon a bulletin board, wall, kitchen cabinet or the like. No further attachment is required and the user is not distracted in the course of looking for attaching implements such as tape, magnets or thumbtacks.

In a preferred embodiment, the polymeric tape selected has an adhesion value of about 38 ounces per inch width and a pigmentation substantially matching the ink pigmentation of any indicia or preprinted message or data provided upon each sheet. In the latter regard, identification of the telephone caller and telephone no. along with message and so forth may be provided in conventional form. One type tape found desirable for use in the instant application is a red, U.P.V.C. tape produced by 3M Company, Saint Paul, Minn.

The design of the note pad assemblage 10 described hereinabove lends itself to highly advantageous fabrication procedures which, while simple, assure the proper alignment of each of the sheets within the assemblage 12 and backing sheet 16. Additionally, the assembly 12 of sheets may be built-up utilizing somewhat elongate widthwise sheet members without the development of undesirable "bloating" effects within the central portions of the resultant elongate or composite assemblage and attendant misalignment of the stacked edges of the sheets. The fabrication procedure is highly efficient and can be implemented to be economically carried out utilizing relatively unskilled manual labor even in the present industrial era of automated assembly. In the latter regard, the technique of assembly available with the instant invention lends itself to application utilizing the labor available, for example, in public supported or sheltered workshops for the mentally handicapped.

Figure 3:
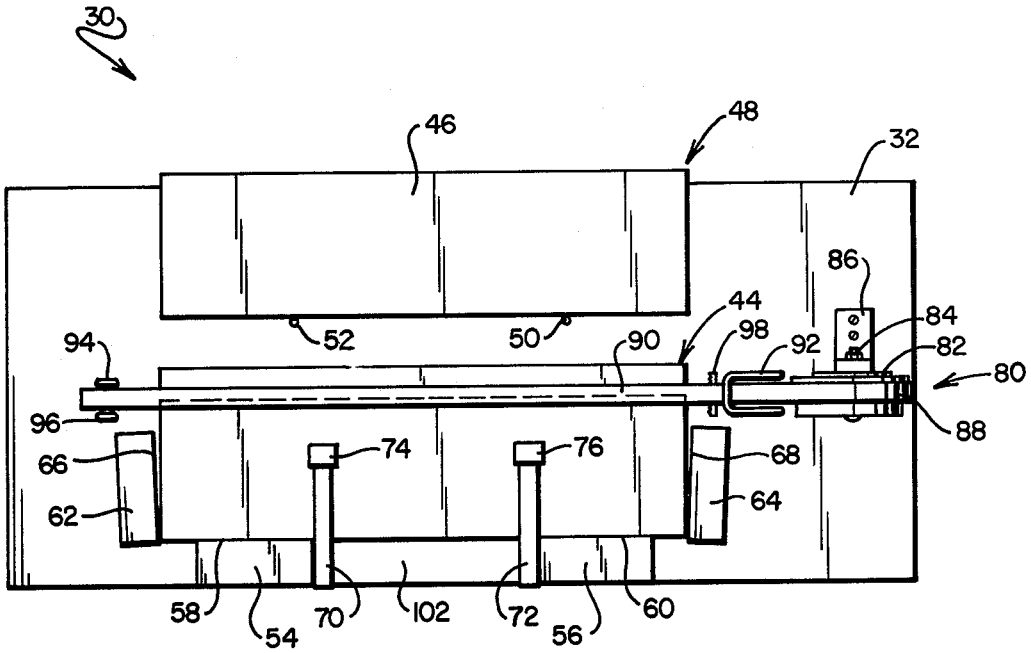
FIG. 3 is a plan view of an assembly station arrangement utilized in connection with the production method of the instant invention.
Figure 4:
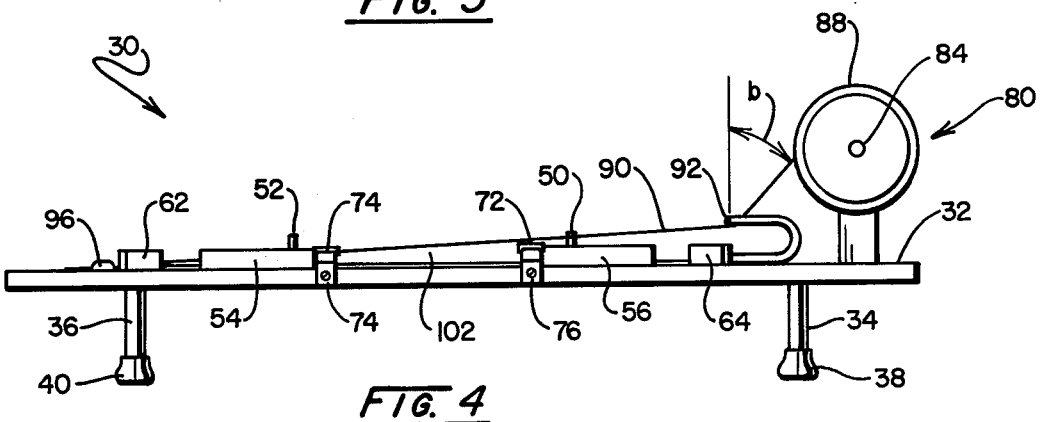
FIG. 4 is a front elevational view of the assembly of FIG. 3 taken in a direction parallel with the upward surface thereof.
Figure 5:
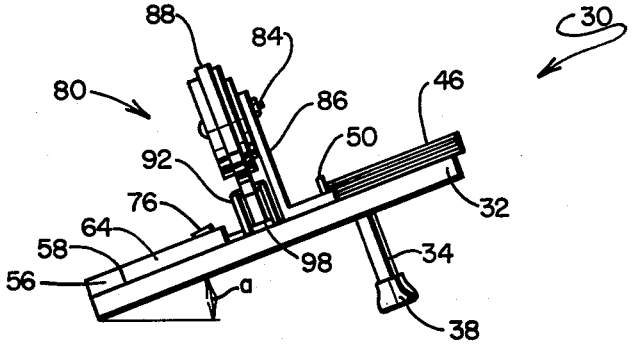
FIG. 5 is a side elevational view of the assembly station of FIG. 3.

Turning to FIGS. 3, 4 and 5, an assembly station for note pads 10 is represented generally at 30. The station includes an assembly surface 32 representing the upwardly disposed surface for example, of a rectangular piece of flakeboard or like rigid material having a smooth upper surface and a nominal thickness of about one inch. As revealed in FIG. 5, surface 32 is inclined at an angle, a, which, preferably, is selected as about 30°. This inclination is provided by legs as at 34 and 36 extending downwardly from the lower portion of the assemblage (FIG. 4). The outwardly disposed edges of legs 34 and 36 respectively are covered by rubber caps shown, respectively at 38 and 40 which serve to prevent lateral motion of assembly 30.

FIGS. 3–5 reveal a utilization of assembly 30 at an intermediate stage in the production of an elongate composite note pad assemblage, in order to more clearly illustrate the functions of the components mounted thereupon. Later herein, a more detailed illustration of the buildup of this composite assembly is set forth. Composite assemblages, as revealed in partially fabricated form at 44 in connection with FIGS. 3, 4 and 5, are assembled in step-by-step fashion from a supply of note pad sheets of rectangular format having an elongate widthwise dimension and located for assembly at a supply station 48. An optimum length for these sheets 46 as well as associated backing sheets as selected as the equivalent of about five note pads widths. Accordingly, for the preferred maximum note pad width dimension of four inches, sheets as at 46 will have a width of about 20 inches. These sheets 46 are stacked and retained upon inclined surface 32 by two spaced studs 50 and 52, which are fixed to and extend upwardly in vertical fashion from surface 32. Backing sheets of elongate width as well as note pad sheets of corresponding width are manually positioned over surface 32 against lower alignment blocks 54 and 56, the operative surfaces of which are shown respectively at 58 and 60. Surfaces 58 and 60 serve to provide a vertical stacked alignment for the lowermost edges of elongate backing sheets and corresponding elongate note pad sheets 46. In this regard, surfaces 58 and 60 extend perpendicularly from surface 32 and are closely adhered to the surface to provide for the elimination of any cracks therebetween which might otherwise engender a misalignment of the lower backing sheet. Widthwise alignment of sheets 46 over each other as well as the backing sheet is provided by lateral alignment blocks 62 and 64. Blocks 62 and 64 are slightly canted outwardly such that their operative surfaces, shown respectively at 66 and 68, serve to guide discrete ones of the sheets 46 as well as an associated elongate backing sheet properly into widthwise alignment as they approach lower alignment block operative surfaces 58 and 60. Composite assemblages 44 additionally are retained in position by elongate spring action clip retainers 70 and 72 which are affixed to an edge of the board component constituting surface 32, as revealed in FIG. 4. Note that simple attachment is made by screws as at 74 and 76. The tip portions of retainers 70 and 72 are canted upwardly to facilitate the receipt of sheets 46 and may be covered with a friction inducing surface such as masking tape or the like to improve the retention of the uppermost one of the sheets at 44. This covering of the tips of retainers 70 and 72 is represented in FIG. 3, respectively, at 74 and 76.

FIGS. 3–5 further reveal a tape supply station, represented generally at 80. Station 80 includes a friction brake tape drum 82 which is mounted for rotation upon an angular support 86 by a bolted connection 84. Tape drum 82 supports a ring-shaped roll of tape 88 which, as noted above, is of a polymeric variety having an adhesive disposed on the lower surface thereof. Preferably, the tape is formed having a width of about one half inch. Brake drums as at 82 are available, for example, from 3M Company, Saint Paul, Minnesota.

Tape supply 80 is so positioned such that lengths of tape as at 90 may be manually drawn therefrom through a tape guide as at 92 so as to be properly positioned over the developing assemblage 44. In this regard, note that guide 92 is so positioned that tape withdrawn from roll 88 is positioned over the immediately adjacent portion of assemblage 44 such that about one half of the width of the tape is positioned over an upper portion of the exposed sheet of assemblage 44 adjacent the upper widthwise edge thereof. The protruding portion of the tape will be positioned over a lowermost adjacent upper tape surface, as represented in FIG. 2. Tape 90 is pulled over assemblage 44 by hand and to an extend that it extends over the entire length of the assemblage. Alignment over the tape in the area adjacent the opposite side of assemblage 44 is provided by upstanding thumb guides 94 and 96. Guides 94 and 96 are simply formed as small blocks extending vertically from surface 32 and are mutually spaced so as to permit insertion therewithin of a human thumb. The inwardly disposed surface of guide 96 is arranged such that the lowermost edge of tape length 90 is properly positioned when adjacent that inward surface.

Looking to FIG. 4, it may be noted that guide 92 is so configured and oriented as to initially position the tape above but in relatively close adjacency to its proper ultimate location upon assemblage 44. Additionally, the tape is removed from the surface of roll 88 at an angle with respect to a perpendicular to surface 30 designated, b, which angle generally is selected as about 45° with minor variations thereto occasioned with the exhaustion of the tape supply 88. When each length of tape 90 is withdrawn from roll 88 through guide 92, a braking action is asserted from drum 82 and, additionally, a retarding influence is asserted thereupon by guide 92 through the presence of a locus of travel which includes the development of angle, *b*. Accordingly, the length of tape 90 is tensioned during the initial extension thereof over assemblage 44. This tensioning is predetermined and varies preferably between 1 and 2.5 pounds for polymeric tape of width amounting to one half inch and of the variety disclosed earlier herein. Tensioning should be selected as a prestressing amounting to a maximum extent of about 20% of the tensile strength of the tape. Upon appropriate adhesive application of tape length 90, the side thereof adjacent station 80 is severed, for example by manual application against an upstanding serrated edge 98 mounted upon surface 32.

Figure 6:
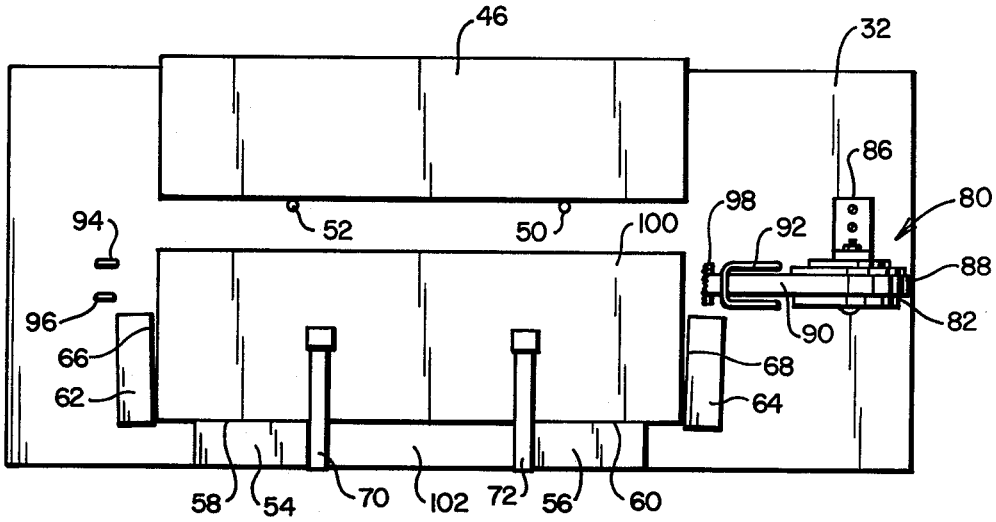
FIG. 6 is a top view of the assembly of FIG. 3 showing a first stage in the production of note pad assemblies according to the invention.

Turning now to FIGS. 6–10, the stepwise procedure of assembling note pad 10 in accordance with the invention is revealed in progressive fashion. FIG. 6 shows the position of a backing sheet 100 of generally elongate widthwise dimension suited for the generation of the preferred five note pads 10. Backing sheet 100 is manually inserted underneath retainer clips 70 and 72 and slid under the influence of the angular cant of surface 32 into adjacency against operative surfaces 58 and 60 of respective blocks 54 and 56. Lateral orientation of sheet 100 is assured by virtue of canted operative surfaces 66 and 68 of respective blocks 62 and 64. A supply of sheets 46 of elongate width is provided above sheet 100, those sheets being supported by studs 50 and 52. A portion of tape 90 is shown extending through guide 92 to terminate in an end which is adhered to an outwardly disposed surface of serrated edge 98.

Figure 7:
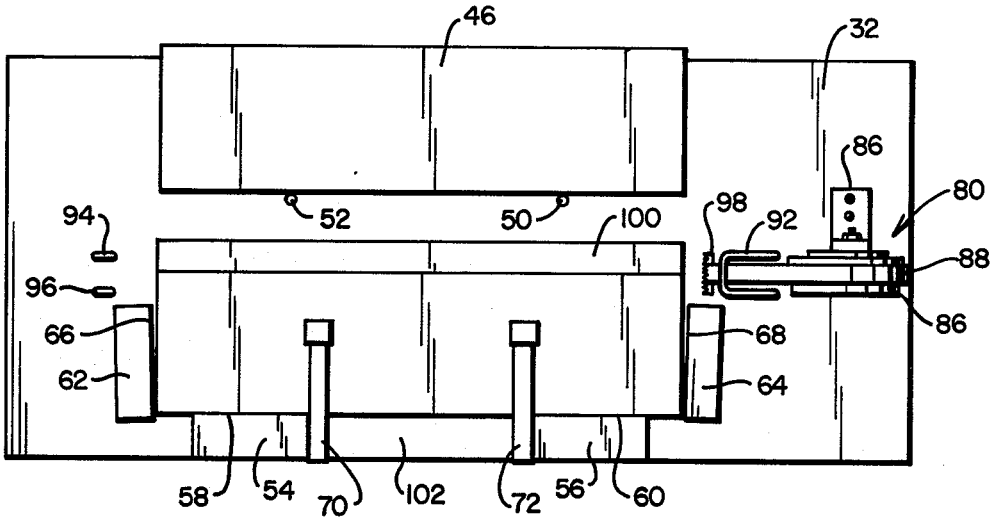
FIG. 7 is a top view of the assembly station of FIG. 3 showing another step in the assembly of note pads according to the invention.

Turning next to FIG. 7, upon the positioning of backing sheet 100, one sheet of supply 46 is maneuvered in the same fashion as the maneuvering of backing sheet 100 to rest against operative surfaces 58 and 60 of respective blocks 54 and 56. As before, surfaces 66 and 68 facilitate the guidance of this sheet, representing the last sheet in the assembly, into proper orientation aligned with the lowermost and side edges of elongate backing sheet 100. Retainer clips 70 and 72 hold the middle portion of this last sheet in proper position. Additionally, it is found that the gap 102 defined between blocks 54 and 56 permits the expulsion of air entrapped during the positioning of the sheet to avoid the noted "bloating" effects normally encountered during assembly. Note additionally, that the earlier described exposed surface portion 18 of backing sheet 100 is defined with this first positioning of the last sheet of the assemblage.

Figure 8:
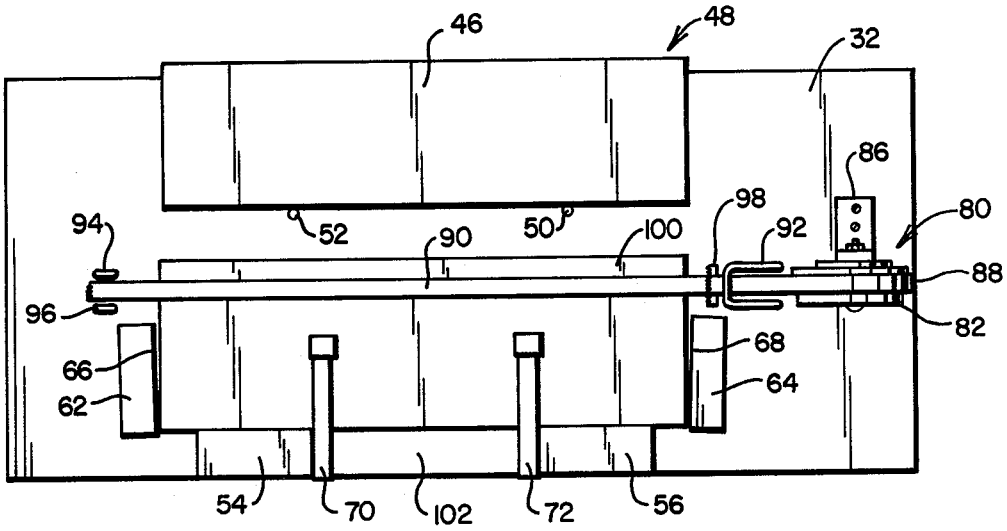
FIG. 8 is a top view of the assembly station of the invention showing still another step in the fabrication of note pad assemblies.

Looking next to FIG. 8, fabrication is shown as having progressed to a point wherein the operator has extended length 90 of tape from roll 88 in proper position over the upper portion of the lowermost sheets as well as exposed portions of backing sheet 100. Appropriate positioning of tape length 90 opposite guide 92 is provided by the noted thumb guides 94 and 96. During the extension of tape length 90 from station 80, the above-noted desired tensioning thereof is asserted both by the angular imposition of tape exiting from roll 88 and by the affects of brake drum 82. This results in a tensioning amounting to a maximum value of about 20% of the tensile strength of the tape. The value of tensioning is selected so that tape length 90 will not curl upon itself. However, sufficient tension is provided such that no rippling effect is derived as successive layers of tape are superimposed one upon the other in the course of fabrication of the assemblage.

Upon appropriate extension and pretensioning of tape length 90, the operator adheres this first length thereof to surface 32 and using a thumb or finger applies pressure thereupon to adhesively attach it in appropriate position against the lower-most sheet as well as backing sheet 100. Following this application, length of tape 90 is severed by manual application thereof against serrated edge 98. Following the above procedure, another sheet from supply 46 is dropped into position in the manner described immediately above and the taping procedure is reiterated until a composite assemblage amounting to a preferred 20 sheets adhesively affixed to backing sheet 100 is derived. As this build-up occurs, the noted avoidance of bloating is provided through the pressure applied from retainer clips 70 and 72 as well as by the presence of gap 102.

Figure 9:
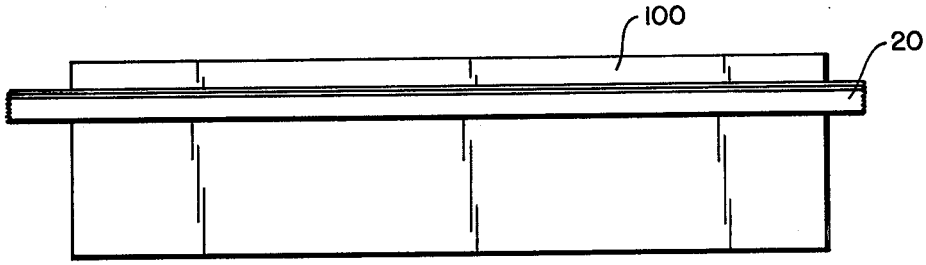
FIG. 9 is a plan view of a composite assemblage of note pads prior to the press cutting thereof.
Figure 10:
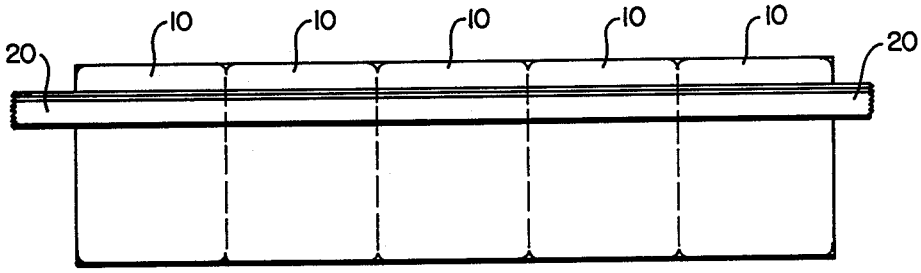
FIG. 10 is a view of the composite assemblage of FIG. 9 showing the location of cutting lines providing for the severence of discrete note pads therefrom.

A composite assemblage of sheets from supply 46 over backing sheet 100 then is removed from the assembly apparatus and will have the general structure revealed in FIG. 9. This composite assemblage then is introduced to a press cutter wherein five individual note pad assemblages 10 are finally formed. FIG. 10 reveals the final shaping carried out by the press cutter. Note that the outward extensions of the laminar compilation of tape strips 90 are removed, and the peripheral edges of each discrete note pad 10 are rounded in this cutting procedure.

Using the manual assembly procedure described, it has been found that production can reach about 120 note pads per hour. The importance of the angular cant of surface 32 may be realized, inasmuch as it has been found that such production drops to less than one fourth of the above quantity without the presence thereof.

Of course, automated machinery can be adapted to carry out the procedures described hereinabove. However, with the technique and method now taught, the note pad assemblages 10 can be produced by hand under reasonable cost considerations. It further may be noted that even though tape strips 90 are individually pretensioned, the curl effect otherwise expected in development of the pad assemblages 10 is avoided to permit the provision of a tape-upon-tape assemblage without undesirable rippling effects. As noted hereinabove, this is occasioned inasmuch as a polymeric type and adhesive laminar compilation representing a self-supported structure is evolved in the development of the note pad assemblage.

Since certain changes may be made in the above product and method of its fabrication without departing from the scope of the invention herein involved, it is intended that all matter contained in the above description or shown in the accompanying drawings shall be interpreted as illustrative and not in a limiting sense.

What is claimed is:

1. An assemblage of paper sheets suited for recording written information thereon and a subsequent adhesive posting thereof wherein they are utilized progressively from uppermost first to lowermost last, comprising:

a backing sheet having a generally rectangular configuration of predetermined width and height and selected having a given paper stock density;

a plurality of said sheets, each having a generally rectangular configuration, one edge dimension of which is less than the said predetermined width or height of said backing sheet;

said sheets being stacked in substantial edge alignment and positioned upon the upward surface of said backing sheet in an orientation exposing at least a portion of said upwardly disposed backing sheet surface;

discrete lengths of poylmeric tape of predetermined width, each carrying an adhesive upon a downwardly disposed surface thereof, each said discrete length of tape being prestressed and affixed to and over an extent of about one half said tape predetermined width to an associated said sheet in the vicinity of one edge thereof, said tape having a portion protruding over such edge;

said protruding portion of said length of tape which is affixed to said last sheet being adhesively affixed to said backing sheet exposed regions; and the said protruding portion of each successive said length of tape and associated said sheet being adhesively affixed to the upwardly disposed surface of an adjacent lower disposed said length of tape protruding portion so as to provide composite laminar assemblage of said prestressed lengths of tape protruding portions, each retaining an associated said sheet from first to last in aligned, stacked adjacency upon said backing sheet.

2. The assemblage of paper sheets of claim 1 in which each said discrete length of polymeric tape is prestressed to a maximum extent of about 20% of the tensile strength thereof.

3. The assemblage of paper sheets of claim 1 in which the said height of said backing sheet is greater than the corresponding said height of said sheets to establish said backing sheet exposed portion.

4. The assemblage of paper sheets of claim 1 in which each said length of polymeric tape carries an adhesive having an adhesion value of about 38 ounces per inch width.

5. The assemblage of paper sheets of claim 1 in which said backing sheet is formed of about 197 pound Tag and said sheets are formed of about 16 lb. paper stock.

6. The assemblage of paper sheets of claim 1 in which:

said height of said backing sheet is greater than the corresponding height of said sheets to establish said backing sheet exposed portion;

said backing sheet and said sheets have equal widths which are equal to or less than about 4 inches; and said backing sheet is formed of a paper stock material more rigid and dense than said sheets.

7. The method of assembling an assemblage of paper sheets suited for recording written information and subsequent posting of such sheets progressively from the uppermost first thereof to the lowermost last thereof, comprising the steps of:

providing a backing sheet of generally rectangular configuration having a predetermined height and an elongate width selected as sufficient to provide a plurality of said assemblages;

providing a plurality of said sheets of generally rectangular configuration each said sheet having an elongate width substantially corresponding to that of said backing sheet and a height selected as less than the corresponding height of said backing sheet;

positioning one said backing sheet upon an inclined surface such that the lower widthwise edge thereof rests against at least two spaced supports extending outwardly from said inclined surface;

positioning said last sheet in said elongate form over the upwardly disposed surface of said backing sheet in a manner wherein the lower widthwise edge thereof rests against said spaced supports and in alignment with said backing sheet lower widthwise edge and wherein the upper widthwise edge of said last sheet defines an exposed surface portion of said backing sheet;

extending and tensioning an initial length of adhesive carrying polymeric tape over a portion of said last elongate sheet adjacent said upper widthwise edge and a portion of said exposed backing sheet portion;

adhesively applying said length of tape, while tensioned, to said portion of said elongate sheet adjacent said upper widthwise edge of said last sheet and a portion of said backing sheet exposed surface portion;

positioning a next said sheet having an elongate width over said lowermost last sheet in a manner wherein the lower widthwise edge thereof rests against said spaced supports;

extending and tensioning a next length of adhesive carrying polymeric tape over at least a portion of said last sheet having an elongate width adjacent the upper widthwise edge thereof;

adhesively applying said tensioned next length of tape upon at least a portion of said next sheet having an elongate width adjacent the upward widthwise edge thereof and only over the exposed portion of said initial length of polymeric tape; and positioning next successive sheets having an elongate width, extending next lengths of polymeric tape and adhesively affixing said sheets in substantial reiteration of the next preceeding three steps until a said first uppermost sheet having an elongate width is attached within said assembly to provide a composite assemblage.

8. The method of claim 7 including the step of shearing discrete assemblages from said composite assemblage.

9. The method of claim 7 wherein said tensioning of said polymeric tape is carried out to an extent representing about 20% of the tensile strength thereof;

10. The method of claim 7 wherein said backing sheet and elongate sheet positioning is carried out upon a said surface inclined at an angle of about 30° with respect to horizontal.

* * * * *